US008893500B2

(12) United States Patent
Oskam

(10) Patent No.: US 8,893,500 B2
(45) Date of Patent: Nov. 25, 2014

(54) LEAN DIRECT FUEL INJECTOR

(75) Inventor: Gareth W. Oskam, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 563 days.

(21) Appl. No.: 13/110,210

(22) Filed: May 18, 2011

(65) Prior Publication Data

US 2012/0291439 A1 Nov. 22, 2012

(51) Int. Cl.

| | |
|---|---|
| ***F02C 1/00*** | (2006.01) |
| ***F02G 3/00*** | (2006.01) |
| ***F23D 11/10*** | (2006.01) |
| ***F23R 3/36*** | (2006.01) |
| ***F23D 17/00*** | (2006.01) |
| ***F23R 3/28*** | (2006.01) |

(52) U.S. Cl.

CPC ..... *F23R 3/36* (2013.01); *F23D 11/103* (2013.01); *F23D 17/002* (2013.01); *F23D 2900/00008* (2013.01); *F23R 3/286* (2013.01)

USPC ..... 60/740; 60/737; 60/738; 60/742; 60/739

(58) Field of Classification Search

USPC ..... 60/737–748

See application file for complete search history.

(56) References Cited

U.S. PATENT DOCUMENTS

| | | | |
|---|---|---|---|
| 1,322,999 | A | 11/1919 | Bester |
| 2,206,070 | A | 7/1940 | Andler |
| 2,551,276 | A | 5/1951 | McMahan |
| 2,607,193 | A | 8/1952 | Berggren et al. |
| 2,612,405 | A | 9/1952 | Kirschbaum |
| 2,850,875 | A | 9/1958 | Gähwyler |
| 2,911,035 | A | 11/1959 | Nieman et al. |
| 2,968,925 | A | 1/1961 | Blevans et al. |
| 3,013,732 | A | 12/1961 | Webster et al. |

(Continued)

FOREIGN PATENT DOCUMENTS

| | | | |
|---|---|---|---|
| DE | 102005022772 | A1 | 1/2007 |
| DE | 102007062896 | A1 | 7/2008 |
| DE | 102007038220 | A1 | 2/2009 |
| EP | 444811 | A1 | 9/1991 |

(Continued)

OTHER PUBLICATIONS

Tacina, R., A Low NOx Lean-Direct Injection, Multipoint Integrated Module Combustor Concept for Advanced Aircraft Gas Turbines, NASA TM-2002-211347, Apr. 2002.

(Continued)

*Primary Examiner* — Craig Kim

(74) *Attorney, Agent, or Firm* — Finnegan, Henderson, Farabow, Garrett & Dunner LLP

(57) ABSTRACT

A dual fuel injector for a gas turbine engine includes a central cavity extending along a longitudinal axis from a first end to a second end, and a first fuel discharge outlet configured to direct a first fuel into the central cavity at the first end. The fuel injector may also include a first air discharge opening circumferentially disposed about the first fuel discharge outlet and configured to direct a first quantity of air into the central cavity, and a second air discharge opening circumferentially disposed about the central cavity and configured to discharge a second quantity of air into the central cavity downstream of the first air discharge outlet. The fuel injector may further include a second fuel discharge outlet circumferentially disposed about the central cavity and configured to discharge a second fuel therethrough. The second fuel may be different from the first fuel.

15 Claims, 5 Drawing Sheets

(56) References Cited

U.S. PATENT DOCUMENTS

| | | | |
|---|---|---|---|
| 3,285,007 | A | 11/1966 | Carlisle et al. |
| 3,302,399 | A | 2/1967 | Tini et al. |
| 3,310,240 | A | 3/1967 | Grundman |
| 3,430,443 | A | 3/1969 | Richardson et al. |
| 3,474,970 | A | 10/1969 | Simmons et al. |
| 3,533,558 | A | 10/1970 | Masters |
| 3,570,242 | A | 3/1971 | Leonardi et al. |
| 3,638,865 | A | 2/1972 | McEneny et al. |
| 3,684,186 | A | 8/1972 | Helmrich |
| 3,703,259 | A | 11/1972 | Sturgess et al. |
| 3,811,278 | A | 5/1974 | Taylor et al. |
| 3,853,273 | A | 12/1974 | Bahr et al. |
| 3,866,413 | A | 2/1975 | Sturgess |
| 3,886,736 | A | 6/1975 | Kawaguchi |
| 3,899,884 | A | 8/1975 | Ekstedt |
| 3,934,409 | A | 1/1976 | Quillévéré et al. |
| 3,937,011 | A | 2/1976 | Caruel et al. |
| 3,938,324 | A | 2/1976 | Hammond, Jr. et al. |
| 3,972,182 | A | 8/1976 | Salvi |
| 3,980,233 | A | 9/1976 | Simmons et al. |
| 4,052,844 | A | 10/1977 | Caruel et al. |
| 4,058,977 | A | 11/1977 | Markowski et al. |
| 4,092,826 | A | 6/1978 | Pask |
| 4,105,163 | A | 8/1978 | Davis, Jr. et al. |
| 4,139,157 | A | 2/1979 | Simmons |
| 4,168,803 | A | 9/1979 | Simmons et al. |
| 4,180,974 | A | 1/1980 | Stenger et al. |
| 4,193,260 | A | 3/1980 | Carlisle et al. |
| 4,198,815 | A | 4/1980 | Bobo et al. |
| 4,215,535 | A | 8/1980 | Lewis |
| 4,278,418 | A | 7/1981 | Strenkert |
| 4,285,664 | A | 8/1981 | Voorheis |
| 4,292,801 | A | 10/1981 | Wilkes et al. |
| 4,389,848 | A | 6/1983 | Markowski et al. |
| 4,407,128 | A | 10/1983 | Kwan |
| 4,410,140 | A | 10/1983 | Nowak |
| 4,418,543 | A | 12/1983 | Faucher et al. |
| 4,425,755 | A | 1/1984 | Hughes |
| 4,443,182 | A | 4/1984 | Wojcieson et al. |
| 4,445,338 | A | 5/1984 | Markowski et al. |
| 4,483,137 | A | 11/1984 | Faulkner |
| 4,499,735 | A | 2/1985 | Moore et al. |
| 4,532,762 | A | 8/1985 | Mongia et al. |
| 4,584,834 | A | 4/1986 | Koshoffer et al. |
| 4,600,151 | A | 7/1986 | Bradley |
| 4,609,150 | A | 9/1986 | Pane, Jr. et al. |
| 4,671,069 | A | 6/1987 | Sato et al. |
| 4,693,074 | A | 9/1987 | Pidcock et al. |
| 4,726,192 | A | 2/1988 | Willis et al. |
| 4,731,989 | A | 3/1988 | Furuya et al. |
| 4,754,922 | A | 7/1988 | Halvorsen et al. |
| 4,831,700 | A | 5/1989 | Halvorsen et al. |
| 4,845,940 | A | 7/1989 | Beer |
| 4,854,127 | A | 8/1989 | Vinson et al. |
| 4,887,425 | A | 12/1989 | Vdoviak |
| 4,891,935 | A | 1/1990 | McLaurin et al. |
| 4,898,001 | A | 2/1990 | Kuroda et al. |
| 4,928,481 | A | 5/1990 | Joshi et al. |
| 4,938,019 | A | 7/1990 | Angell et al. |
| 4,938,417 | A | 7/1990 | Halvorsen |
| 4,967,551 | A | 11/1990 | Faulkner |
| 4,974,416 | A | 12/1990 | Taylor |
| 4,974,571 | A | 12/1990 | Oppenheim et al. |
| 5,000,004 | A | 3/1991 | Yamanaka et al. |
| 5,001,895 | A | 3/1991 | Shekleton et al. |
| 5,014,918 | A | 5/1991 | Halvorsen |
| 5,020,329 | A | 6/1991 | Ekstedt et al. |
| 5,062,792 | A | 11/1991 | Maghon |
| 5,069,029 | A | 12/1991 | Kuroda et al. |
| 5,102,054 | A | 4/1992 | Halvorsen |
| 5,115,634 | A | 5/1992 | Bretz et al. |
| 5,117,637 | A | 6/1992 | Howell et al. |
| 5,121,608 | A | 6/1992 | Willis et al. |
| 5,123,248 | A | 6/1992 | Monty et al. |
| 5,154,060 | A | 10/1992 | Walker et al. |
| 5,161,366 | A | 11/1992 | Beebe |
| 5,165,241 | A | 11/1992 | Joshi et al. |
| 5,201,181 | A | 4/1993 | Ohmori et al. |
| 5,209,067 | A | 5/1993 | Barbier et al. |
| 5,224,333 | A | 7/1993 | Bretz et al. |
| 5,251,447 | A | 10/1993 | Joshi et al. |
| 5,256,352 | A | 10/1993 | Snyder et al. |
| 5,259,184 | A | 11/1993 | Berkowicz et al. |
| 5,267,442 | A | 12/1993 | Clark |
| 5,274,995 | A | 1/1994 | Horner et al. |
| 5,394,688 | A | 3/1995 | Amos |
| 5,404,711 | A | 4/1995 | Rajput |
| 5,423,173 | A | 6/1995 | Lemon et al. |
| 5,452,574 | A | 9/1995 | Cowell et al. |
| 5,491,972 | A | 2/1996 | Bretz et al. |
| 5,505,045 | A | 4/1996 | Lee et al. |
| 5,540,056 | A | 7/1996 | Heberling et al. |
| 5,558,515 | A | 9/1996 | Althaus et al. |
| 5,569,020 | A | 10/1996 | Griffin et al. |
| 5,590,529 | A | 1/1997 | Joshi et al. |
| 5,592,819 | A | 1/1997 | Ansart et al. |
| 5,603,211 | A | 2/1997 | Graves |
| 5,605,287 | A | 2/1997 | Mains |
| 5,613,363 | A | 3/1997 | Joshi et al. |
| 5,615,555 | A | 4/1997 | Mina |
| 5,623,827 | A | 4/1997 | Monty |
| 5,638,682 | A | 6/1997 | Joshi et al. |
| 5,647,538 | A | 7/1997 | Richardson |
| 5,664,412 | A | 9/1997 | Overton |
| 5,680,766 | A | 10/1997 | Joshi et al. |
| 5,688,115 | A | 11/1997 | Johnson |
| 5,697,553 | A | 12/1997 | Stotts |
| 5,737,921 | A | 4/1998 | Jones et al. |
| 5,761,907 | A | 6/1998 | Pelletier et al. |
| 5,822,992 | A | 10/1998 | Dean |
| 5,826,429 | A | 10/1998 | Beebe et al. |
| 5,833,141 | A | 11/1998 | Bechtel, II et al. |
| 5,836,163 | A | 11/1998 | Lockyer et al. |
| 5,899,074 | A | 5/1999 | Komatsu et al. |
| 5,899,076 | A | 5/1999 | Snyder et al. |
| 5,908,160 | A | 6/1999 | Kramer et al. |
| 5,930,999 | A | 8/1999 | Howell et al. |
| 5,960,724 | A | 10/1999 | Toqan et al. |
| 5,966,937 | A | 10/1999 | Graves |
| 6,021,635 | A | 2/2000 | Gaag et al. |
| 6,038,861 | A | 3/2000 | Amos et al. |
| 6,068,470 | A | 5/2000 | Zarzalis et al. |
| 6,070,411 | A | 6/2000 | Iwai et al. |
| 6,076,356 | A | 6/2000 | Pelletier |
| 6,082,111 | A | 7/2000 | Stokes |
| 6,101,814 | A | 8/2000 | Hoke et al. |
| 6,141,967 | A | 11/2000 | Angel et al. |
| 6,189,314 | B1 | 2/2001 | Yamamoto et al. |
| 6,286,298 | B1 | 9/2001 | Burrus et al. |
| 6,295,801 | B1 | 10/2001 | Burrus et al. |
| 6,301,899 | B1 | 10/2001 | Dean et al. |
| 6,311,496 | B1 | 11/2001 | Alkabie |
| 6,363,726 | B1 | 4/2002 | Durbin et al. |
| 6,367,262 | B1 | 4/2002 | Mongia et al. |
| 6,374,615 | B1 | 4/2002 | Zupanc et al. |
| 6,378,310 | B1 | 4/2002 | Le Gal et al. |
| 6,405,523 | B1 | 6/2002 | Foust et al. |
| 6,415,594 | B1 | 7/2002 | Durbin et al. |
| 6,418,726 | B1 | 7/2002 | Foust et al. |
| 6,457,316 | B1 | 10/2002 | Czachor et al. |
| 6,484,489 | B1 | 11/2002 | Foust et al. |
| 6,755,024 | B1 | 6/2004 | Mao et al. |
| 6,871,488 | B2 | 3/2005 | Oskooei et al. |
| 6,871,501 | B2 | 3/2005 | Bibler et al. |
| 6,931,854 | B2 | 8/2005 | Saitoh et al. |
| 6,945,051 | B2 | 9/2005 | Benelli et al. |
| 6,968,692 | B2 | 11/2005 | Chin et al. |
| 6,976,363 | B2 | 12/2005 | McMasters et al. |
| 6,993,916 | B2 | 2/2006 | Johnson et al. |
| 7,010,923 | B2 | 3/2006 | Mancini et al. |
| 7,251,940 | B2 | 8/2007 | Graves et al. |
| 7,343,745 | B2 | 3/2008 | Inoue et al. |
| 7,406,827 | B2 | 8/2008 | Bernero et al. |
| 7,415,826 | B2 | 8/2008 | McMasters et al. |

(56) References Cited

U.S. PATENT DOCUMENTS

| | | | | |
|---|---|---|---|---|
| 7,464,553 | B2 | 12/2008 | Hsieh et al. | |
| 7,506,510 | B2 | 3/2009 | Thomson | |
| 7,520,272 | B2 | 4/2009 | Fritz et al. | |
| 7,536,862 | B2 | 5/2009 | Held et al. | |
| 7,546,734 | B2 | 6/2009 | Dorr et al. | |
| 7,546,735 | B2 * | 6/2009 | Widener | 60/746 |
| 2005/0039456 | A1 | 2/2005 | Hayashi | |
| 2005/0224606 | A1 | 10/2005 | Dingle | |
| 2008/0236165 | A1 * | 10/2008 | Baudoin et al. | 60/746 |
| 2008/0302105 | A1 * | 12/2008 | Oda et al. | 60/737 |
| 2010/0269506 | A1 * | 10/2010 | Nonaka et al. | 60/742 |
| 2012/0180490 | A1 * | 7/2012 | Takami et al. | 60/740 |

FOREIGN PATENT DOCUMENTS

| | | | |
|---|---|---|---|
| EP | 780638 | A2 | 6/1997 |
| EP | 1719950 | A2 | 11/2006 |
| EP | 1424526 | A3 | 4/2007 |
| EP | 1959196 | A2 | 8/2008 |
| EP | 1959197 | A2 | 8/2008 |
| GB | 2432206 | A | 5/2007 |
| WO | WO 2005121649 | A3 | 9/2006 |

OTHER PUBLICATIONS

U.S. Appl. No. 13/110,179 titled "Method of Operating a Gas Turbine Engine", May 18, 2011, 24 pages.

* cited by examiner

LEAN DIRECT FUEL INJECTOR

TECHNICAL FIELD

The present disclosure relates generally to a fuel injector for direct injection of fuels into a combustion chamber of an engine, and more particularly, to a fuel injector configured for direct injection of multiple fuels into a combustor of a gas turbine engine.

BACKGROUND

Gas turbine engines (GTE) produce power by extracting energy from a flow of hot gas produced by combustion of fuel in a stream of compressed air. In general, turbine engines have an upstream air compressor coupled to a downstream turbine with a combustion chamber ("combustor") in between. Energy is released when a mixture of compressed air and fuel is burned in the combustor. The resulting hot gases are directed over blades of the turbine to spin the turbine and produce mechanical power. In a typical turbine engine, one or more fuel injectors direct a liquid or gaseous hydrocarbon fuel into the combustor for combustion. In some turbine engines, the fuel injectors are adapted to direct both a liquid fuel and gaseous fuel to the combustor (called dual fuel injectors). Depending upon availability, either a liquid fuel or a gaseous fuel may be directed to the combustor through these fuel injectors. In addition to producing power, combustion of hydrocarbon fuels in the combustor produces undesirable exhaust constituents such as $NO_x$. It is desirable to reduce the emission of these undesirable constituents from GTEs. The formation of $NO_x$ in the combustor increases exponentially with the temperature of the flame in the combustor. Thus, a modest reduction in flame temperature can significantly reduce the emission of $NO_x$ from a GTE. One technique used to reduce the emission of $NO_x$ from GTEs is to premix the fuel and air in the fuel injector to provide a lean fuel-air mixture to the combustor. This lean fuel-air mixture burns to produce a flame with a relatively low temperature and, thus, reduce $NO_x$ formation. However, a lean premixed fuel-air mixture may not be appropriate for all fuels. Fuels, such as synthesis gas (or any other fuel whose fundamental reaction rates, as indicated by the "laminar flame speed" $S_L$, are very high) contain hydrogen, and may be prone to a phenomenon in which the flame front moves upstream against the flow of the air-fuel mixture, to cause an undesirable condition known as flashback. Other gaseous fuels and many liquid fuels are prone to a phenomenon known as autoignition. Autoignition is a phenomenon related to the chemical properties of the fuel whereby, when a fuel is mixed with an oxidizer, the oxidation reaction begins without the influence of an external source of energy such an electrical spark or another flame. Autoignition properties are well known for many fuels and are related to the pressure and temperature of the fuel and oxidizer mixture, and the time at which the mixture has been subject to those conditions. Lean Direct injection (LDI) of fuel into the combustor can be used to avoid flashback and autoignition. In an LDI system, fuel is directly injected into an air stream in a combustor and ignited in the combustor. However, if the fuel and air are not well mixed before combustion occurs, regions with higher fuel content may burn hotter and generate more $NO_N$.

U.S. Pat. No. 7,536,862 B2 to Held et al. (the '862 patent) describes a fuel nozzle for a gas turbine engine in which fuel is injected from the nozzle tip into the combustor through a primary and a secondary opening. In the '862 patent, steam is injected alongside the fuel to decrease the temperature of the flame in the combustor, and thereby reduce $NO_x$ production. While the nozzle of the '862 patent may directly inject the fuel into the combustor and reduce $NO_x$ production, it may have limitations. For instance, injection of steam may detrimentally affect the efficiency of the gas turbine engine. Further, the fuel nozzle of the '862 patent is configured to inject only one type of fuel into the combustor and therefore may not be applicable to applications where it is desired to direct two different fuels through the fuel injector. The fuel injectors disclosed in the current application may overcome these or other limitations in existing technology.

SUMMARY

In one aspect, a dual fuel injector for a gas turbine engine is disclosed. The fuel injector includes a central cavity extending along a longitudinal axis from a first end to a second end, and a first fuel discharge outlet configured to direct a first fuel into the central cavity at the first end. The fuel injector may also include a first air discharge opening circumferentially disposed about the first fuel discharge outlet and configured to direct a first quantity of air into the central cavity, and a second air discharge opening circumferentially disposed about the central cavity and configured to discharge a second quantity of air into the central cavity downstream of the first air discharge outlet. The fuel injector may further include a second fuel discharge outlet circumferentially disposed about the central cavity and configured to discharge a second fuel therethrough. The second fuel may be different from the first fuel.

In another aspect, a dual fuel injector for a gas turbine engine is disclosed. The fuel injector includes a first fuel outlet positioned in a cavity that extends along a longitudinal axis. The first fuel outlet may be configured to direct a fuel stream through the cavity along the longitudinal axis. The fuel injector may also include an air outlet configured to discharge air into the fuel stream such that a shell of air surrounds the fuel stream as the air and the fuel stream travel downstream through the cavity. The fuel injector may also include a second fuel outlet positioned downstream of the first fuel outlet.

In yet another aspect, a gas turbine engine is disclosed. The gas turbine engine includes a compressor system, a combustor system with a combustor, and a dual fuel injector fluidly coupling the compressor system and the combustor. The fuel injector may include a liquid fuel nozzle centrally positioned in a cavity of the fuel injector. The liquid fuel nozzle may be configured to direct a liquid fuel stream through the cavity into the combustor. The fuel injector may also include an air discharge opening circumferentially positioned around the cavity downstream of the liquid fuel nozzle. The air discharge opening may be configured to direct an air stream into the cavity such that the air stream forms a shell around the liquid fuel stream as the liquid fuel stream travels towards the combustor. The fuel injector may also include a gas fuel passageway axi-symmetrically positioned about the longitudinal axis and configured to discharge a gaseous fuel into the combustor downstream of the air discharge opening.

DETAILED DESCRIPTION

Figure 1:
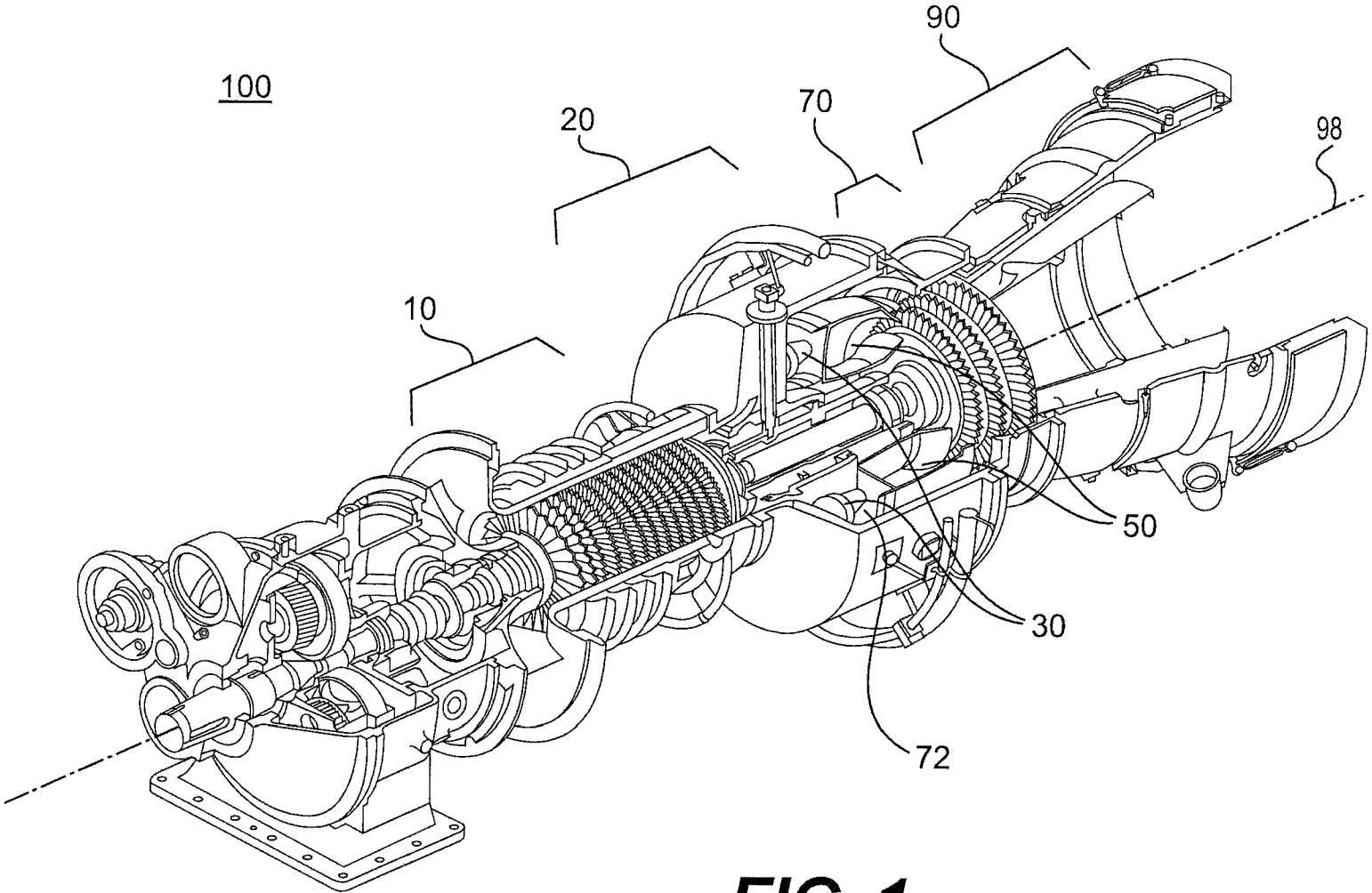
FIG. 1 is an illustration of an exemplary disclosed gas turbine engine system.

FIG. 1 illustrates an exemplary gas turbine engine (GTE) 100. GTE 100 may have, among other systems, a compressor system 10, a combustor system 20, a turbine system 70, and an exhaust system 90 arranged along an engine axis 98. Compressor system 10 compresses air and delivers the compressed air to an enclosure 72 of combustor system 20. The compressed air is then directed from enclosure 72 into a combustor 50 through one or more dual fuel injectors 30 (hereinafter referred to as fuel injector 30) positioned therein. One or more types of fuel (such as, for example, a gaseous fuel and a liquid fuel) may also be directed to the fuel injector 30 through fuel lines (not identified). GTE 100 may operate using one or more of these fuels depending upon availability of a particular fuel. For instance, when GTE 100 operates at a site with an abundant supply of a gaseous fuel (such as natural gas), the gaseous fuel may be used to operate the GTE 100. This fuel may be directed into the combustor 50 through the fuel injectors 30. The fuel burns in combustor 50 to produce combustion gases at high pressure and temperature. These combustion gases are used in the turbine system 70 to produce mechanical power. Turbine system 70 extracts energy from these combustion gases, and directs the exhaust gases to the atmosphere through exhaust system 90. The layout of GTE 100 illustrated in FIG. 1, and described above, is only exemplary and fuel injectors 30 of the current disclosure may be used with any configuration and layout of GTE 100.

Figure 2:
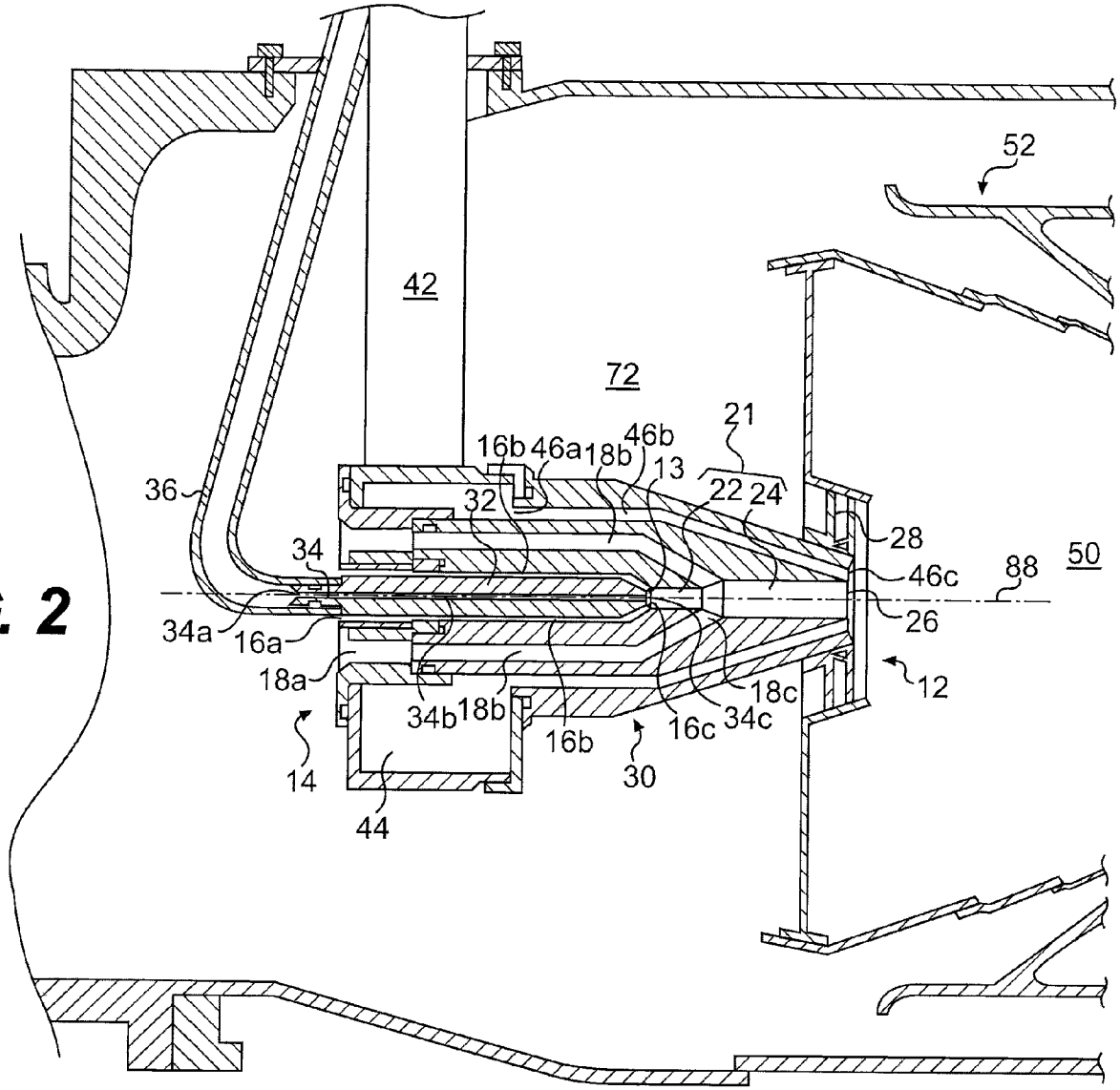
FIG. 2 is a cross-sectional illustration of an exemplary fuel injector used in the turbine engine of FIG. 1.
Figure 3:
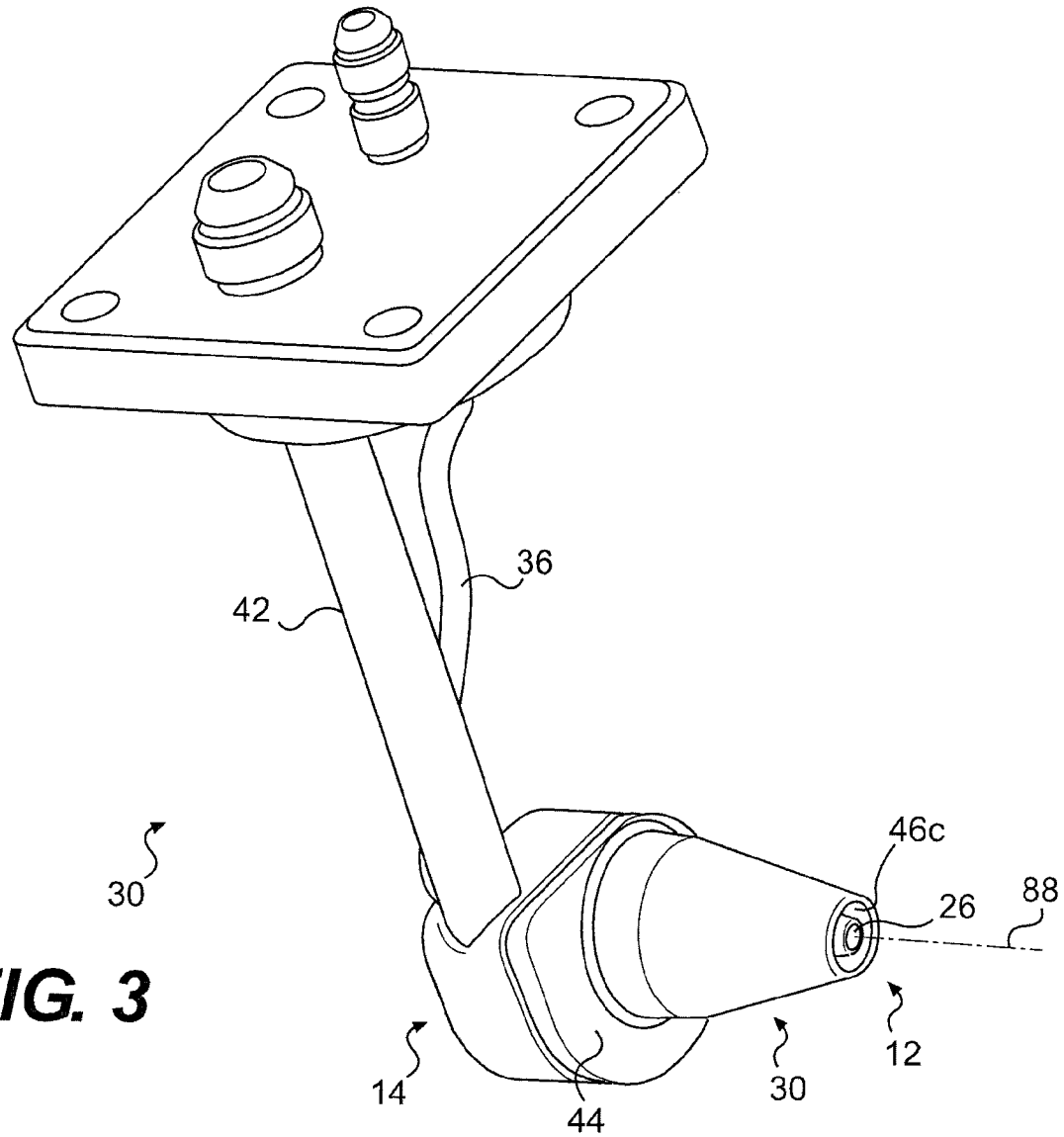
FIG. 3 is a perspective view of the fuel injector of FIG. 2.

FIG. 2 is a cross-sectional view of an embodiment of a fuel injector 30 that is coupled to combustor 50 of GTE 100. As previously described, fuel injector 30 is a dual fuel injector that is configured to deliver different types of fuel (for example, gaseous and liquid fuel) to the combustor 50. FIG. 3 illustrates an external view of the fuel injector 30 of FIG. 2. In the description that follows, reference will be made to both FIGS. 2 and 3. Fuel injector 30 extends from a first end 12 to a second end 14 along a longitudinal axis 88. The first end 12 of the fuel injector 30 may be coupled to combustor 50, and the second end 14 of the fuel injector 30 may extend into enclosure 72. As is known in the art, combustor 50 is an annular chamber, bounded by a liner 52, located around engine axis 98 of GTE 100 (see FIG. 1). Compressed air from enclosure 72 enters fuel injector 30 through one or more openings 16*a* and 18*a* at the second end 14 of fuel injector 30. These openings 16*a* and 18*a* may have any shape, size, and angle of entry, and may be annularly positioned around the longitudinal axis 88. In some embodiments, the openings 16*a* and 18*a* may be configured such that the flow of air into the fuel injector 30 through these openings is substantially axial (that is, along the longitudinal axis 88). In some embodiments, in addition to an axial component of velocity, these openings 16*a*, 18*a* may be configured to induce a tangential (angular) component of velocity to the air flowing into the fuel injector 30 through these openings.

Air that enters through openings 16*a* flows through an inner air passage 16*b* and enters a central cavity 21 of the fuel injector 30 at a first zone 22, through a first air discharge outlet 16*c*. Air that enters fuel injector 30 through openings 18*a* flows through an outer air passage 18*b* and enters the central cavity 21 at a second zone 24, through a second air discharge outlet 18*c*. Inner and outer air passages 16*b*, 18*b*, are passages that are axi-symmetrically disposed about the longitudinal axis 88. The outer air passage 18*b* may be positioned radially outwardly of the inner air passage 16*b*, and the second air discharge outlet 18*c* may be located downstream of the first air discharge outlet 16*c*. The air directed into the central cavity 21 through the inner air passage 16*b* may mix with the air directed into the central cavity 21 through the outer air passage 18*b* and enter the combustor 50 through opening 26.

First zone 22 is an upstream region of the central cavity 21, and the second zone 24 is a downstream region of the central cavity 21. The central cavity 21 is a passage that extends centrally through the fuel injector 30 along the longitudinal axis 88 and opens into the combustor 50 at an opening 26 at the first end 12. The central cavity 21 can have any shape depending upon the application. In general, the configuration of the central cavity 21 is such that a fluid flowing therethrough accelerates towards the combustor 50 due to the pressure difference existing between enclosure 72 and combustor 50. In some embodiments, the central cavity 21 may have a cylindrical shape with a first constant diameter along its length in the first zone 22 and a different second constant diameter along its length in the second zone 24. In some embodiments, the diameters of the first zone 22 and the second zone 24 may be substantially the same. In other embodiments, the diameter may vary along the length of the central cavity 21. For instance, in some embodiments, the diameter at a downstream end (that is, proximate first end 12) may be smaller than the diameter at an upstream end (that is, proximate second end 14) such that the central cavity 21 converges from the upstream end to the downstream end. In some embodiments, the central cavity 21 may have a generally divergent shape in the downstream direction. In some embodiments, the first zone 22 may have a first divergent shape in the downstream direction while the second zone 24 may have a second divergent shape in the downstream direction. It is also contemplated that the first and the second zones 22, 24 may have different convergent shapes in the downstream direction.

Compressed air from enclosure 72 also enters the combustor 50 through an air swirler 28 positioned circumferentially outwardly of the fuel injector 30 at the first end 12. Air swirler 28 may include one or more blades or vanes shaped to induce a swirl to the compressed air passing therethough. Although the air swirler 28 illustrated in FIG. 2 is an axial air swirler, any type of air swirler known in the art (for example, radial air swirler) may be used. As the compressed air from the enclosure 72 flows into the combustor 50 through the air swirler 28, a swirl will be induced to the air. This swirled air will spin outwardly and move towards the outer walls of combustor 50. Since air swirlers and their role in the functioning of GTE 100 are known in the art, for the sake of brevity, air swirler 28 is not discussed in detail herein.

Fuel injector 30 includes a liquid fuel tube 36 and a gas fuel pipe 42 that direct a liquid fuel and a gaseous fuel, respectively, into the fuel injector 30. Any type of liquid fuel and gaseous fuel may be supplied through liquid fuel tube 36 and gas fuel pipe 42. In some embodiments, the liquid fuel may be diesel fuel, and the gaseous fuel may be natural gas or a hydrogen containing fuel. The gaseous fuel from the gas fuel pipe 42 enters the fuel injector 30 at a toroidal annular cavity 44 at the second end 14 of fuel injector 30. Annular cavity 44 may be a snail shell shaped cavity in which the area of the cavity decreases with distance around the longitudinal axis 88. The gas fuel pipe 42 may be coupled to the annular cavity 44 such that the gaseous fuel from the gas fuel pipe 42 enters the annular cavity 44 tangentially and travels around the annular cavity 44. As the gaseous fuel travels through the gradually narrowing annular cavity 44, a spin is introduced into the gaseous fuel.

A gas fuel passage 46*b* directs the gaseous fuel from the annular cavity 44 to the combustor 50. The gas fuel passage 46*b* extends between an inlet 46*a* and an outlet 46*c*. The inlet 46*a* fluidly couples the annular cavity 44 to the gas fuel passage 46*b* proximate the second end 14, and the outlet 46*c* fluidly couples the gas fuel passage 46*b* to the combustor 50 at the first end 12. As illustrated in FIG. 3, the fuel injector 30 may have a shape resembling the frustum of a cone proximate the first end 12. Because of this generally conical shape, the gas fuel passage 46*b* may progressively converge towards the longitudinal axis 88 as it approaches the outlet 46*c*. That is, the radial distance of the gas fuel passage 46*b* from the longitudinal axis 88 may decrease towards the outlet 46*c*. This decreasing radial distance may progressively decrease the cross-sectional area of the passage as it approaches the outlet 46*c*. The decreasing cross-sectional area may increase the linear velocity of the gaseous fuel in the gas fuel passage 46*b* as it moves towards the outlet 46*c*. The decreasing radial distance may also increase the spin or the angular velocity of the gaseous fuel in the gas fuel passage 46*b* as it flows from the inlet 46*a* to the outlet 46*c*. Therefore, the shape of the gas fuel passage 46*b* may increase both the angular velocity and the linear velocity of the gaseous fuel as it flows towards the outlet 46*c*.

Due to the increased angular velocity of the gaseous fuel exiting the gas fuel passage 46*b* into the combustor 50, the gaseous fuel will spin outwardly and move in a direction away from the longitudinal axis 88 (because of conservation of angular momentum). This outwardly moving gaseous fuel will meet and mix with the swirled air stream from the air swirler 28 and rapidly mix prior to combustion (see FIG. 4). Thus, the increased angular velocity of the gaseous fuel facilitates thorough and rapid mixing of the gaseous fuel with the air upon entering the combustor 50. The thorough and rapid mixing reduces the flame temperature, and thereby the $NO_x$ production, in the combustor 50. It is also contemplated that, in some embodiments, mixing may occur immediately after combustion. The increased linear velocity of the gaseous fuel exiting the fuel injector 30 will push the fuel away from the fuel injector 30 and reduce the likelihood of flashback. The angle of convergence $\theta_3$ of the gas fuel passage 46*b* may be any value and may depend upon the application. In some exemplary embodiments, an angle of convergence $\theta_3$ of between about 20° and 80° is suitable to provide rapid mixing of the gaseous fuel. Although a converging gas fuel passage 46*b* is illustrated herein, any configuration of the gas fuel passage 46*b* in which the cross-sectional area of the passage, transverse to the longitudinal axis 88, decreases from the inlet 46*a* to the outlet 46*c* may be used with fuel injector 30.

Fuel injector 30 also includes a fuel sprayer 32 that extends from the second end 14 to a tip end 13 along the longitudinal axis 88. The fuel sprayer 32 includes a central bore 34 extending along the longitudinal axis 88 from the second end 14 to the tip end 13. At the second end 14, fuel sprayer 32 is coupled to the fuel tube 36 that directs the liquid fuel into bore 34. Bore 34 includes an inlet 34*a* at the second end 14, a nozzle 34*c* at the tip end 13, and a liquid fuel passage 34*b* extending between the inlet 34*a* and the nozzle 34*c*. Any type of liquid fuel (for example, diesel fuel, kerosene, etc.) may be directed to the combustor 50 through the fuel sprayer 32.

Figure 4:
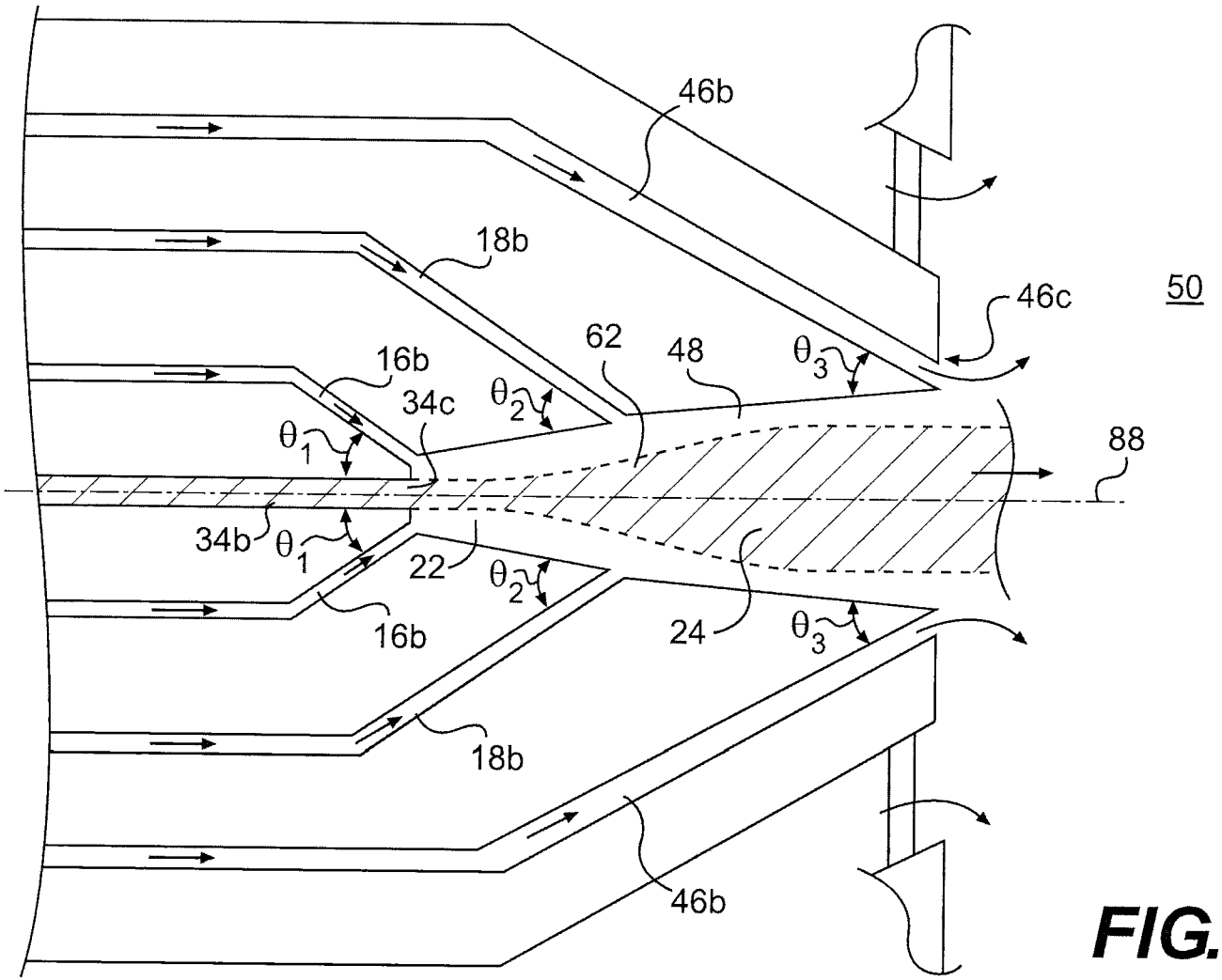
FIG. 4 is an illustration of the fuel and air flow paths of the fuel injector of FIG. 2.

FIG. 4 schematically illustrates the flow of air, liquid fuel, and gaseous fuel flow into the combustor 50 through the fuel injector 30. In the discussion that follows, reference will be made to both FIGS. 2 and 4. The liquid fuel from the liquid fuel tube 36 may be injected into the first zone 22 of the central cavity 21 through the nozzle 34*c*. The inner air passage 16*b* of the fuel injector 30 is circumferentially disposed outwardly of the fuel sprayer 32, with the first air discharge outlet 16*c* positioned radially outwardly of, and proximate, nozzle 34*c*. In some embodiments, the first air discharge outlet 16*c* may be a ring-shaped opening located radially outwardly of nozzle 34*c*. The air directed into the first zone 22 may assist in atomization and transport of the liquid fuel into the combustor 50. The inner air passage 16*b* may also include a portion that converges towards the longitudinal axis 88 with a converging angle $\theta_1$. As discussed previously with reference to the gas fuel passage 46*b*, this converging portion may increase the linear and angular velocities of the air stream exiting the inner air passage 16*b*. In general, the converging angle $\theta_1$ may be any value. In some embodiments, a converging angle $\theta_1$ of between about 30° and 40° will be suitable. The size of the inner air passage 16*b* will be such that the mass flow rate of air directed through the inner air passage 16*b* is relatively small. The low mass flow rate will ensure that atomization of the liquid fuel will only be initiated in the first zone 22. That is, the air stream from the inner air passage 16*b* will only form droplets in the liquid fuel, or cause rippling of the liquid fuel, in the first zone 22, and will not cause substantial mixing of the liquid fuel with the air. Therefore, the liquid fuel stream 62 in the first zone 22 remains substantially in liquid form, with atomization initiated. Positioning the first air discharge outlet 16*c* around the nozzle 34*c*, and directing the air flow around the liquid fuel stream 62 emanating from the nozzle 34*c* may also ensure that the liquid fuel stream 62 travels downstream through the central cavity 21 without contacting the walls of the central cavity 21. As will be described later, keeping the liquid fuel away from the walls of the central cavity may decrease the likelihood of flashback in the liquid fuel.

As the liquid fuel stream 62 travels downstream through the first zone 22 and enters the second zone 24, the liquid fuel stream 62 may meet with the compressed air from the outer air passage 18*b* exiting into the central cavity 21 through the second air discharge outlet 18*c*. The outer air passage 18*b* may also include a portion that converges towards the longitudinal axis 88 with a converging angle $\theta_2$. This converging portion may increase the linear and angular velocities of the air stream exiting the outer air passage 18*b*. In general, the converging angle $\theta_2$ may have any value. In some applications, a converging angle $\theta_2$ between about 30° and 40° will be suitable. The outer air passage 18*b* may direct an higher mass flow rate of air into the fuel injector 30 than the inner air passage 16*b*. This air stream may form a shell 48 of air around the liquid fuel stream 62 traveling through the second zone 24 and minimize the possibility of the liquid fuel touching the walls of the inner cavity 21. Air through the outer air passage 18*b* is directed into the central cavity 21 in a manner such that the liquid fuel and the air remain relatively unmixed in the second zone 24. The increased angular velocity of the air in the converging portion of the outer air passage 18*b* may assist in the formation of the shell 48 around the liquid fuel stream 62 and maintaining the fuel and the air in an unmixed state. As the unmixed air and liquid fuel stream 62 flow through the second zone 24, a layer of air proximate the walls of the central cavity 21 (boundary layer) will experience a lower velocity due to interaction with the walls. It is known that decreasing the velocity of a fuel stream increases the likelihood of flashback, and that the slower boundary layers of a fuel stream are the regions that cause flashback. The presence of the air shell 48 around the liquid fuel stream 62 prevents the liquid fuel from contacting the walls and experiencing the decrease in velocity. Therefore, the air shell 48 around the liquid fuel stream 62 in the second zone 24 decreases the likelihood of flashback in the liquid fuel.

A common concern with dual fuel injectors is the cross-contamination of fuel delivery lines during operation. During operation, combustion driven turbulent pressure fluctuations may induce small pressure variations in the vicinity of different fuel injectors 30 in the combustor 50. These pressure differences may induce one type of fuel to migrate into the fuel lines of the other fuel and degrade to create carbonaceous deposits or ignite therein. For example, if the GTE 100 is operating with gaseous fuel, the pressure variations may cause the gaseous fuel to migrate into idle liquid fuel lines and decompose or ignite therein. And, if the GTE 100 is operating with liquid fuel, the liquid fuel may enter idle gas fuel lines and ignite or decompose to cause coking. In fuel injector 30, the air shell 48 around the liquid fuel stream 62 will help to prevent the liquid fuel from migrating into the gas fuel passage 46*b* when GTE 100 operates on liquid fuel. The increased angular momentum of the gaseous fuel, the physical separation of the gas and the liquid fuel outlets, and the continuous air flow through the central cavity 21 will help to prevent the gaseous fuel from migrating into the fuel sprayer 32, when GTE 100 is operating on gaseous fuel. Thus, fuel injector 30 reduces the possibility of cross-contamination.

The physical separation between outlet 46*c* of the gas fuel passage 46*b* and nozzle 34*c* of the fuel sprayer 32 may depend upon the operating parameters (air pressure, etc.) of GTE 100 and the existing spatial constraints in an application. In general, this physical separation may be any value. In general, the spacing between outlet 46*c* and nozzle 34*c* will be such that no (or minimal) premixing of fuel and air occurs before the liquid fuel stream 62 enters the combustor 50. In some embodiments, the spacing between the outlet 46*c* and the nozzle 34*c* will be such that the time it takes for the liquid fuel stream 62 to enter the combustor 50 is less than or equal to about 1 millisecond. In these embodiments, knowing the flow rate or the velocity of the liquid fuel, the longitudinal distance between the outlet 46*c* and nozzle 34*c* may be calculated as velocity×time. The size and configuration of the fuel and air passages may also depend on the application (Wobbe number of the fuels, etc.). Air flow through the inner air passage 16*b* is mainly provided to initiate atomization and assist in transportation of the liquid fuel. Excessive air flow through the inner air passage 16*b* may cause mixing of the liquid fuel with the air. Premixing of the liquid fuel with air before combustion may detrimentally affect the performance of GTE 100 by providing the conditions for autoignition and flashback. Therefore, the size of the inner air passage 16*b* is selected to provide sufficient amount of air for atomization without causing premixing. In some embodiments, the inner air passage 16*b* is sized such that only about 0.1 to 1.5% of the total injection air directed to the combustor 50 is directed through this passage. Air flow through the outer air passage 18*b* is used to create a shell 48 around the liquid fuel stream 62. Excessive amounts of air through this passage may cause mixing of the air with the liquid fuel. Therefore, in some embodiments, in order to provide a sufficiently robust shell 48 while minimizing the mixing of air with liquid fuel, about 1% to 6% of the total injection air flows through the outer air passage 18*b*. In some embodiments, the air flow through the inner air passage 16*b* and the outer air passage 18*b* may be reduced to about 0.25-1% and about 2-4%, respectively, of the total injection air flow to the combustor 50. The remaining injection air (not sent through the inner and outer air passages 16*b*, 18*b*) is directed through the air swirler 28. As is known in the art, injection air includes compressed air directed into the combustor 50 through the fuel injector 30 and the air swirler 28. Typically, the injection air is a relatively small portion of the total air entering the combustor 50. For instance, in some GTEs, only roughly 10-20% of the total air entering combustor 50 is injection air, the remainder of the air enters the combustor 50 through primary ports, dilution ports, wall cooling openings, etc.

INDUSTRIAL APPLICABILITY

The disclosed lean direct fuel injector may be applicable to any turbine engine where it is desirable to reduce $NO_x$ emissions, while reducing the possibility of autoignition and flashback. In an embodiment of a lean direct fuel injector that is configured to operate on both gaseous and liquid fuel, the liquid fuel nozzle and the gas fuel outlet are positioned such that cross-contamination of the fuel outlets is minimized. Liquid fuel and air are introduced into the fuel injector in a manner such that the liquid fuel is delivered to the combustor in a substantially unmixed state. The air directed into the fuel injector is configured to reduce the slowing of the liquid fuel stream due to boundary effects and thereby eliminate, or at least reduce, flashback while transit time of fuel in the presence of air within the fuel injector is controlled to eliminate the risk of autoignition. The operation of a gas turbine engine with a lean direct fuel injector will now be described.

Figure 5:
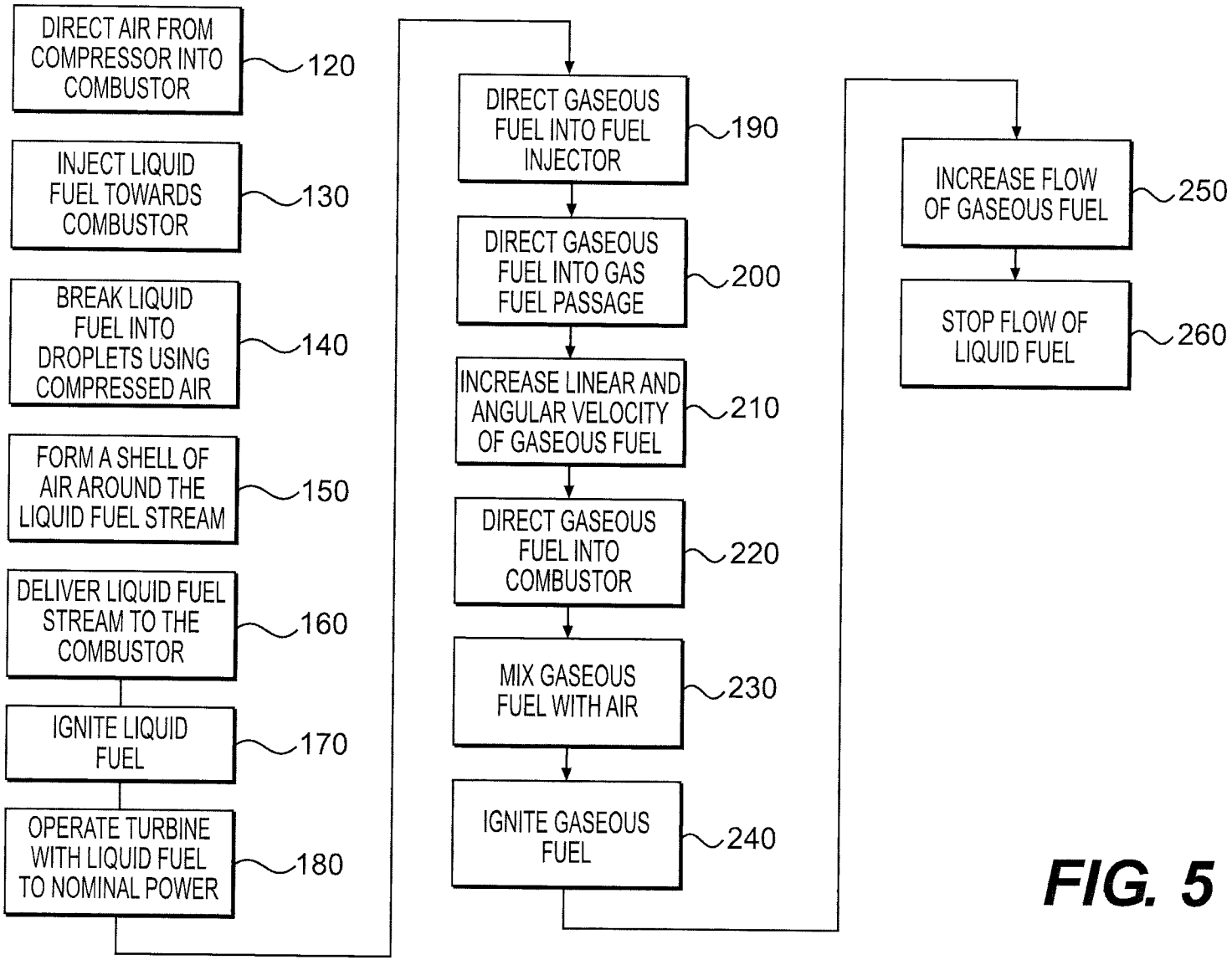
FIG. 5 is a flow chart that illustrates an exemplary operation of the fuel injector of FIG. 2.

FIG. 5 is a flowchart that illustrates an exemplary application of fuel injector 30. GTE 100 may be started with a liquid fuel and then transitioned to a gaseous fuel at a nominal power. During startup, compressed air from enclosure 72 flows into the combustor 50 through the air swirler 28 and through the inner and outer air passages 16*b*, 18*b* of fuel injector 30 (step 120). In an exemplary embodiment, about 0.25-0.75% of the injection air directed to the combustor 50 flows through the inner air passage 16*b*, and about 2.5-3.5% of the injection air flows through the outer air passage 18*b*. The remaining injection air (about 97.25-95.75%) enters the combustor 50 through the air swirler 28. That is, in this exemplary embodiment, the amount of air flowing through the outer air passage 18*b* may be between about 3 (2.5/0.75=3.3) and 14 (3.5/0.75=14) times higher than the amount of air flowing through the inner air passage 16*b*. Liquid fuel, directed into the fuel injector 30 through the liquid fuel tube 36, is injected into the central cavity 21 of the fuel injector 30 through nozzle 34*c* of the fuel sprayer 32 (step 130). This injected fuel forms a liquid fuel stream 62 that travels downstream through the first zone 22 and the second zone 24 of the central cavity 21 to enter the combustor 50 through an opening 26 at the first end 12 of the fuel injector 30. The compressed air entering the central cavity 21 through the first air discharge outlet 16*c* helps to break the liquid fuel in the liquid fuel stream 62 into droplets (step 140). Because of the low flow rate of air through the inner air passage 16*b*, atomization of the liquid fuel only begins in the first zone 22, and the liquid fuel and the air remain unmixed in this zone. That is, the liquid fuel does not mix with air to form a fuel-air mixture in the first zone 22

The relatively higher flow rate of compressed air flowing through the outer air passage 18*b* is directed into the central passage 21 of the fuel injector 30 at the second zone 24. This compressed air is directed into the central passage 21, such that the air surrounds the liquid fuel stream 62 and forms a shell 48 around the liquid fuel stream 62 (step 150). The shell 48 buffers the liquid fuel stream 62 from the walls of the central cavity 21, and prevents (or at least reduces) the liquid fuel from touching these walls. Using the moving blanket of air in the shell 48 to keep the liquid fuel away from the boundary walls of the central passage 21 prevents the formation of a slower moving stream of fuel (proximate the walls) that is known to cause flashback. Since the air and the liquid fuel flow in separate streams through the second zone 24 of the central passage 21, the liquid fuel and the air remain substantially unmixed in this region. Although the liquid fuel and the air remain substantially unmixed in this zone, it is contemplated that a limited amount of mixing may occur at the boundary between the fuel and the air streams. By limiting the amount of mixing the conditions required for autoignition are thereby avoided.

The shell 48 formed around the liquid fuel stream 62 may also prevent (or at least reduce) the migration of the liquid fuel into the gas fuel passage 46*b* as it flows past the outlet 46*c* of the gas fuel passage 46*b*. Preventing the liquid fuel from entering the gas fuel passage 46*b* will eliminate burning/charring of the liquid fuel and associated coking of the gas fuel passage 46*b*. As the liquid fuel stream 62 enters the combustor 50 (step 160), the fuel mixes with the air and ignites (step 170). The combustion mixture rapidly mixes with the air from the air swirler 28 and spreads around the combustor 50. The GTE 100 is then accelerated to a nominal power value (idle speed, a nominal load, etc.) using the liquid fuel (step (180).

Gaseous fuel is directed to the fuel injector 30 through the gas fuel pipe 42 (step 190). The gaseous fuel from the gas fuel pipe 42 travels towards the combustor 50 through the circumferentially disposed gas fuel passage 46*b* (step 200). As the gaseous fuel travels towards the combustor 50 in the gas fuel passage 46*b*, the linear velocity and the angular velocity of the gaseous fuel increases (step 210). The gaseous fuel with the increased linear and angular velocity enters the combustor 50 through outlet 46*c* (step 220). The increased angular velocity of the gaseous fuel causes the fuel to spread outwardly in the combustor 50 and rapidly mix with the air from the air swirler 28 (step 230) and ignite (step 240). The increased linear velocity causes the burning mixture to move away from the fuel injector 30. The flow of gaseous fuel is then increased (step 250) and the liquid fuel supply to the fuel injector is stopped (step 260). The GTE 100 may then operate using gaseous fuel. When the GTE 100 operates using gaseous fuel, the increased angular and linear velocities of the gaseous fuel entering the combustor 50, the physical separation of the liquid and gaseous fuel outlets, and the compressed air flowing downstream through the central passage 21 will prevent the gaseous fuel (or a burning mixture) from migrating to the fuel sprayer 32 due to combustion oscillations.

It will be apparent to those skilled in the art that various modifications and variations can be made to the disclosed lean direct fuel injector. Other embodiments will be apparent to those skilled in the art from consideration of the specification and practice of the disclosed lean direct fuel injector. It is intended that the specification and examples be considered as exemplary only, with a true scope being indicated by the following claims and their equivalents.

What is claimed is:

1. A dual fuel injector for a gas turbine engine comprising:

a central cavity extending along a longitudinal axis from a first end to a second end;

a first fuel discharge outlet configured to direct a first fuel into the central cavity at the first end;

a first air discharge opening circumferentially disposed about the first fuel discharge outlet and configured to direct a first quantity of air into the central cavity;

a second air discharge opening circumferentially disposed about the central cavity and configured to discharge a second quantity of air into the central cavity downstream of the first air discharge outlet;

a second fuel discharge outlet circumferentially disposed about the central cavity and configured to discharge a second fuel therethrough, the second fuel being different from the first fuel; and a second fuel discharge passage extending along the longitudinal axis to fluidly couple an annular cavity containing the second fuel at the second end to the second fuel discharge outlet, the second fuel discharge passage including a portion proximate the second fuel discharge outlet that converges towards the longitudinal axis.

2. The dual fuel injector of claim 1, wherein the first fuel is a liquid fuel and the second fuel is a gaseous fuel.

3. The dual fuel injector of claim 1, wherein the second fuel discharge outlet is positioned downstream of the second air discharge opening.

4. The dual fuel injector of claim 1, wherein in a portion of the second fuel discharge passage, a cross-sectional area transverse to the longitudinal axis decreases towards the second fuel discharge outlet.

5. The dual fuel injector of claim 4, wherein in the portion of the second fuel discharge passage, a radial distance of the passage from the longitudinal axis decreases towards the second fuel discharge outlet.

6. The dual fuel injector of claim 1, further including a first air discharge passage axi-symmetrically disposed about the longitudinal axis and extending from the first air discharge outlet.

7. The dual fuel injector of claim 6, further including a second air discharge passage axi-symmetrically disposed about the longitudinal axis and extending from the second air discharge outlet, the second air discharge passage being positioned radially outwardly of the first air discharge passage.

8. The dual fuel injector of claim 7, wherein the second air discharge passage includes a portion proximate the second air discharge outlet that converges towards the longitudinal axis.

9. The dual fuel injector of claim 6, wherein the first air discharge passage includes a portion proximate the first air discharge outlet that converges towards the longitudinal axis.

10. The dual fuel injector of claim 1, wherein the second quantity of air is between about 3 and 14 times greater than the first quantity of air.

11. A dual fuel injector for a gas turbine engine, comprising:

a first fuel outlet positioned in a cavity that extends along a longitudinal axis, the first fuel outlet being configured to direct a fuel stream through the cavity along the longitudinal axis;

a first air outlet configured to direct a first quantity of air in the cavity;

a second air outlet configured to discharge air into the fuel stream such that a shell of air surrounds the fuel stream as the air and the fuel stream travel downstream through the cavity;

wherein the first air outlet is positioned between the first fuel outlet and the second air outlet; and a second fuel outlet positioned downstream of the first fuel outlet, the second fuel outlet being fluidly coupled to a portion of a second fuel passage that progressively converges towards the longitudinal axis, the second fuel passage fluidly connecting a supply of fuel in an annular cavity at one end of the dual fuel injector to the second fuel outlet.

12. The dual fuel injector of claim 11, wherein the cavity is configured to be fluidly coupled to a combustor of the gas turbine engine proximate the second fuel outlet, and the second fuel outlet is configured to discharge a second fuel into the combustor directed away from the longitudinal axis.

13. The dual fuel injector of claim 11, wherein the fuel stream discharged by the first fuel outlet is a liquid fuel stream and the second fuel discharged by the second fuel outlet is a gaseous fuel.

14. The dual fuel injector of claim 11, wherein the first air outlet being configured to direct a smaller quantity of air into the fuel stream than the second air outlet.

15. The dual fuel injector of claim 14, wherein the first air outlet and the second air outlet are annular openings circumferentially positioned around the cavity.

* * * * *